US007251844B2

(12) United States Patent
Tai et al.

(10) Patent No.: US 7,251,844 B2
(45) Date of Patent: Aug. 7, 2007

(54) SHOWER HEAD WITH EXFOLIATING MEMBERS

(76) Inventors: Ching-Ju Tai, No. 10-6, Beiping 3rd St., North District, Taichung City 404 (TW); Wei-Hsiang Li, No. 33, Jhihsing St., Fongyuan City, Taichung Country 420 (TW)

( * ) Notice: Subject to any disclaimer, the term of this patent is extended or adjusted under 35 U.S.C. 154(b) by 222 days.

(21) Appl. No.: 11/187,717

(22) Filed: Jul. 21, 2005

(65) Prior Publication Data

US 2007/0017020 A1 Jan. 25, 2007

(51) Int. Cl.
*A47K 3/022* (2006.01)
*A47K 3/28* (2006.01)

(52) U.S. Cl. ..... 4/597; 4/605; 4/615; 4/657; 239/397

(58) Field of Classification Search ..... 4/605–611, 4/597, 601, 567–570, 615, 622; 239/436, 239/390, 397; 607/81, 86
See application file for complete search history.

(56) References Cited

U.S. PATENT DOCUMENTS

| | | | | |
|---|---|---|---|---|
| 5,094,742 | A * | 3/1992 | Shalhoob | 210/222 |
| 5,236,126 | A * | 8/1993 | Sawade et al. | 239/DIG. 11 |
| 5,573,664 | A * | 11/1996 | Kuo | 210/222 |
| 6,187,187 | B1 * | 2/2001 | Farley | 239/553.3 |
| 6,814,306 | B1 * | 11/2004 | Okubo | 239/463 |
| 2005/0205475 | A1 * | 9/2005 | Hsu | 137/801 |
| 2006/0161120 | A1 * | 7/2006 | Hoenig | 239/397 |

FOREIGN PATENT DOCUMENTS

JP 09267054 A * 10/1997

* cited by examiner

*Primary Examiner*—Khoa D. Huynh

(57) ABSTRACT

A shower head with exfoliating members is disclosed. A plurality of exfoliating members are affixed to the spraying part at the predetermined positions via magnetic force or positioning holes and positioning rods. Each of these exfoliating members includes exfoliating beads of different size and hence may have a different level of abrasiveness. Also, these exfoliating members do not affect the water spraying function of the shower head. Hence, a user may use any of these exfoliating members to smoothen and rejuvenate his skin while taking a shower.

6 Claims, 5 Drawing Sheets

SHOWER HEAD WITH EXFOLIATING MEMBERS

BACKGROUND OF THE INVENTION

1. Field of the Invention

The invention generally relates to a shower head. More particularly, the invention relates to a shower head, wherein a plurality of exfoliating members with different levels of abrasiveness are arranged on the spraying part of the shower head, so that a user may use the shower head to exfoliate.

2. Description of the Prior Art

A regular shower head of prior art has a spraying part, which allows water to flow out; other shower head of prior art has a spraying part which allows its water flow to be adjusted and hence has a massage function.

However, such shower head only has a massage function via the adjustment of its water flow so as to enhance a user's blood circulation, but it does not have any exfoliating function.

Thicker skin layer forms on specific parts (such as feet, hands, etc.) of human body due to the aging of skin cells and affects the appearance; hence, many people exfoliate periodically so as to get rid of their older skin layers and to rejuvenate their skin.

In exfoliation, a large quantity of water is needed to rinse off the skin flakes; in fact, the best time to exfoliate is when one takes a shower so that skin flakes may be rinsed off immediately. However, a regular shower head of prior art does not have any exfoliating function. A person has to use an exfoliating tool to scrape the skin flakes off; in addition, such a tool has to be put in the bathroom, and this affects the neatness of the bathroom. More importantly, the skin flakes can not be rinsed off immediately. Hence, there is a need for the present invention.

To eliminate the disadvantages of the prior art, the inventor has put in many years of effort in the subject and has come up with the shower head of the present invention.

SUMMARY OF THE INVENTION

An object of the present invention is to provide a shower head with a plurality of exfoliating members having different levels of abrasiveness, so that a user may use the shower head to exfoliate.

Another object of the present invention is to provide such a shower head with exfoliating members: the shower head still has its spraying function, and a user may choose among these exfoliating members to exfoliate.

A third object of the present invention is to provide a shower head with exfoliating members, which allow a user to smoothen and rejuvenate his skin.

To reach the object, the shower head of the present invention comprises: (1) a tube, connected with a water outlet (2) a spraying part, connected with one end of the tube and having an inner side and a rear side (3) a plurality of holes, provided in the inner side of the spraying part, and forming a water outlet area (4) a magnetic element, arranged in the center part of the water outlet area (5) two positioning holes, disposed above and below the magnetic element (6) characterized in that: one or more first exfoliating members are arranged at a predetermined position over the spraying part, and each of the exfoliating members has an exfoliating surface.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
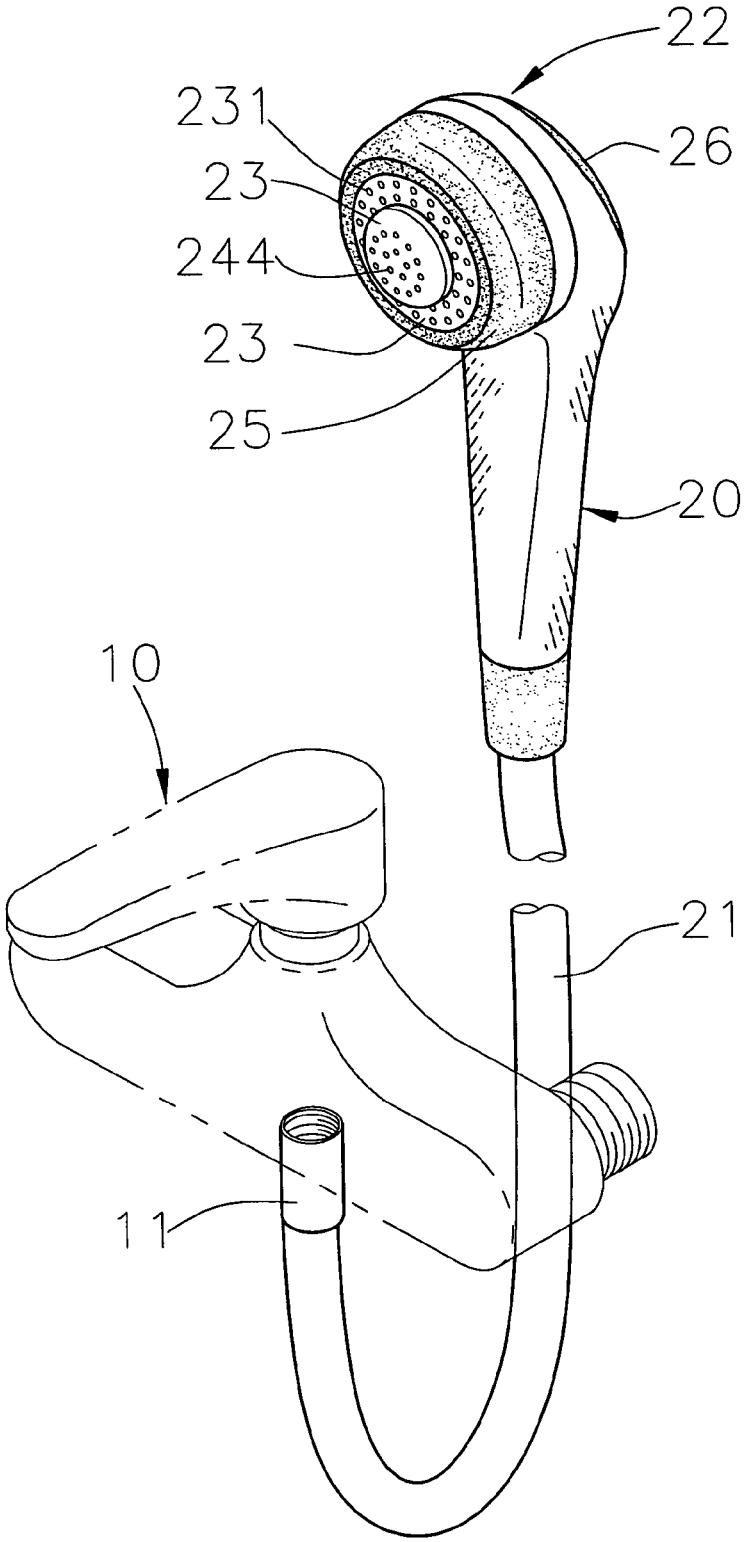
FIG. 1 is a perspective view of the preferred embodiment of the present invention.
Figure 2:
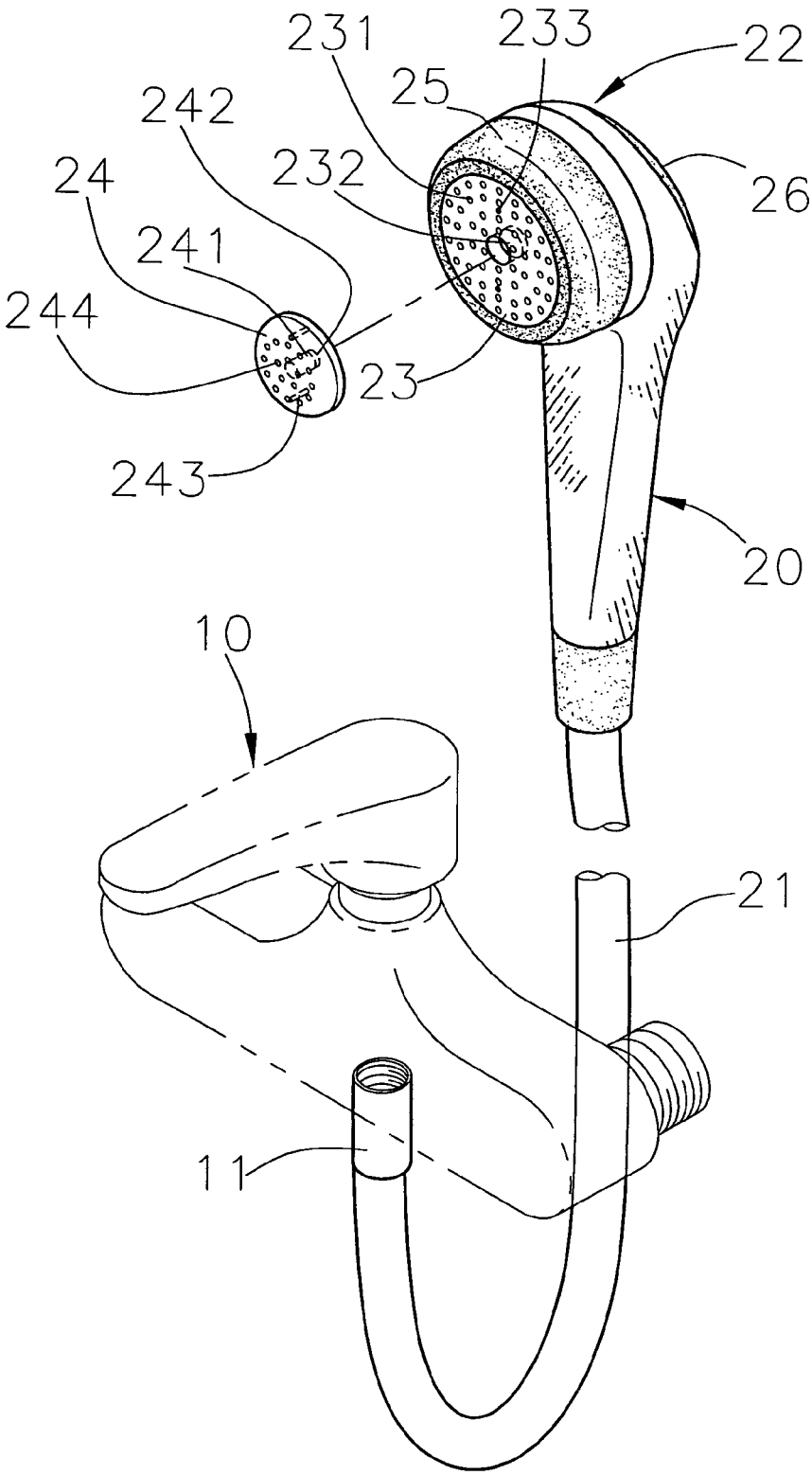
FIG. 2 is a partially exploded view of the preferred embodiment of the present invention.
Figure 3:
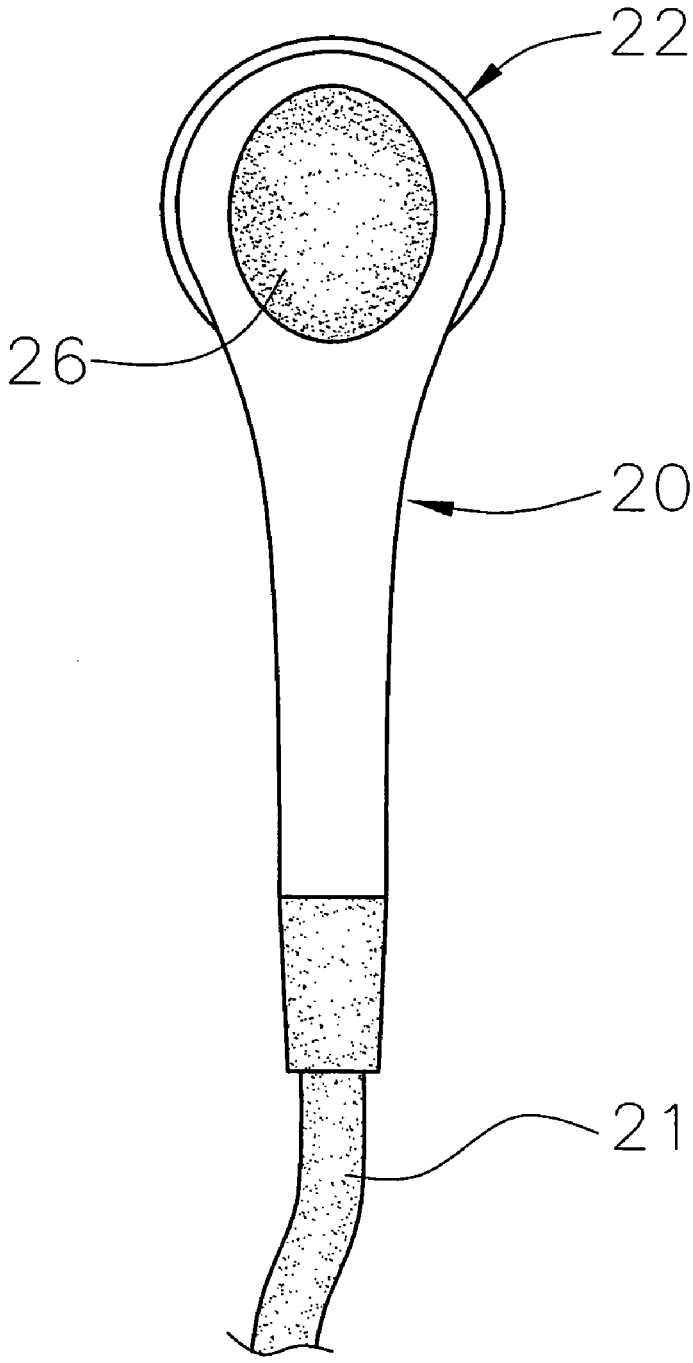
FIG. 3 is a rear plane view of the preferred embodiment of the present invention.
Figure 4:
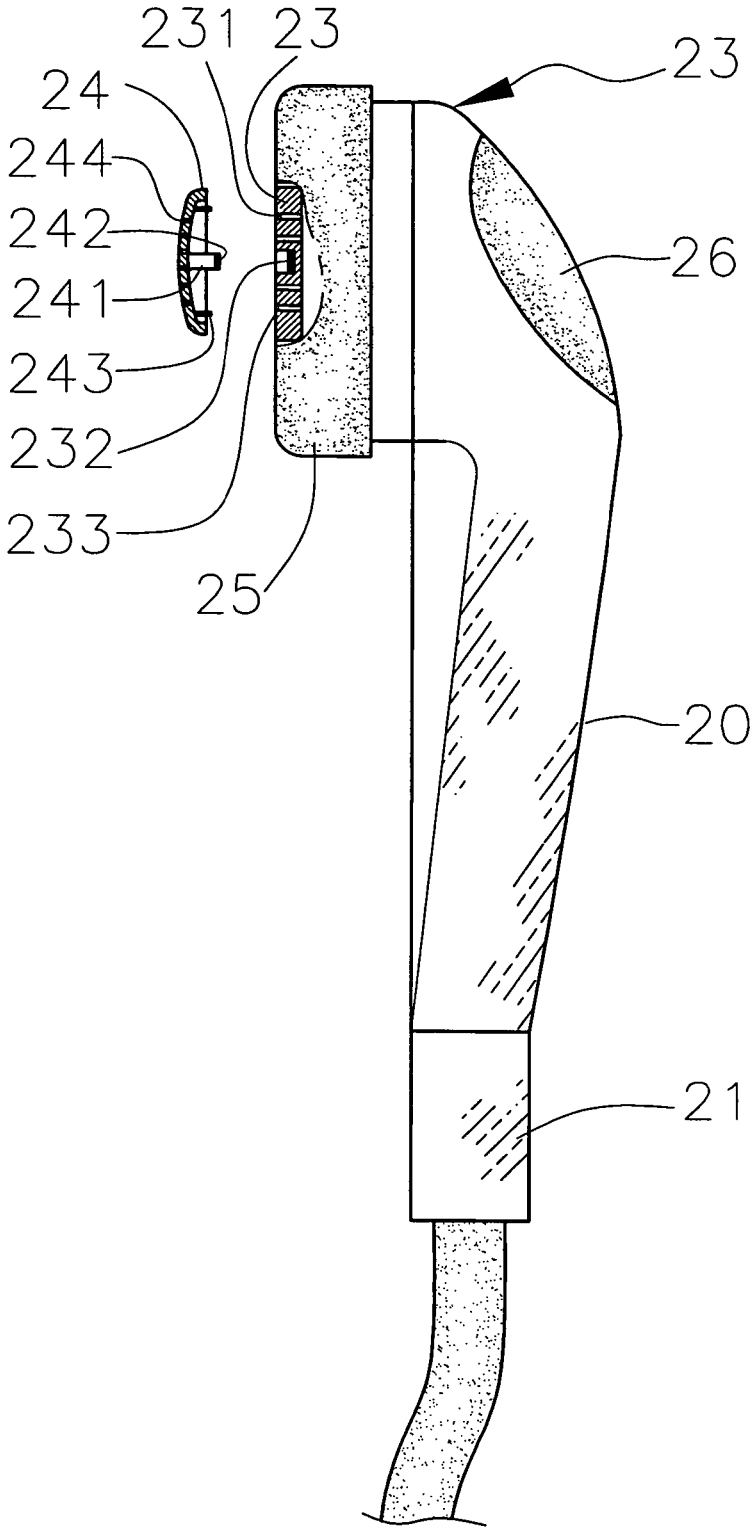
FIG. 4 is a cross sectional view of the preferred embodiment of the present invention, showing its structure.
Figure 5:
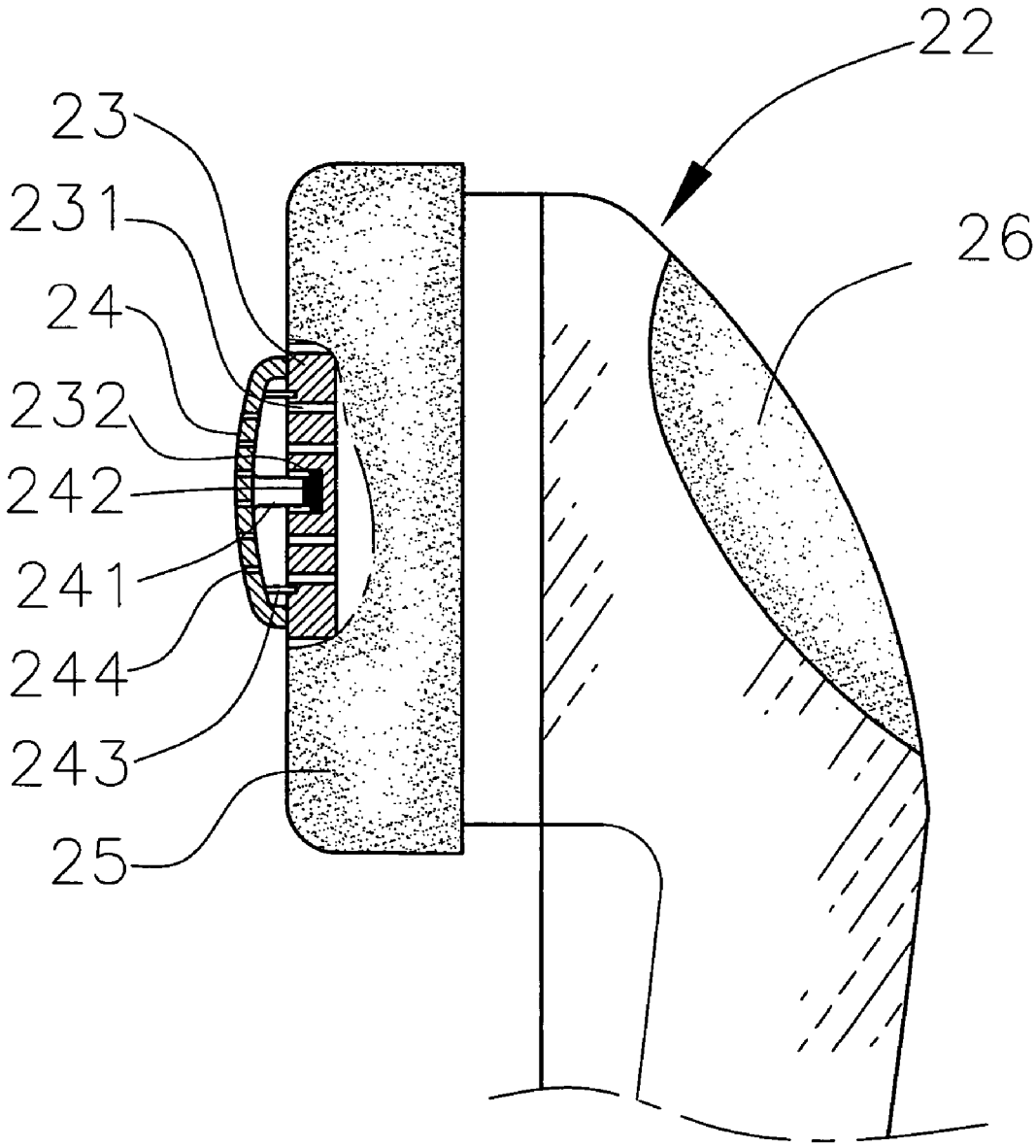
FIG. 5 is a partial cross sectional view of the preferred embodiment of the present invention, showing its structure.

Referring to FIG. 1, the shower head according to the present invention includes a tube 21 and a spraying part 22; the tube 21 is connected with a water outlet 11, and the spraying part 22 is connected with one end of the tube 21 via the handle portion. The spraying part 22 may have a conventional structure: the spraying part 22 has an inner side and a rear side; a plurality of holes 231 are provided in the inner side of the spraying part 22, and these holes form a water outlet area 23.

Referring to FIG. 1 to 5, a faucet 10 to which the shower head 20 of the present invention is connected may be of any of the various kinds of existing faucets connected with a cold water tube and a hot water tube (not shown) and with one or more water outlet 11.

The shower head 20 according to the present invention includes a tube 21 and a spraying part 22; the tube 21 is connected with water outlet 11, and the spraying part 22 is connected with one end of the tube 21. The spraying part 22 may have a conventional structure: the spraying part 22 has an inner side and a rear side; a plurality of water spraying apertures are provided in the inner side of the spraying part 22, and these holes form a water spraying area 23. In addition, first a magnetic element 232 is arranged in the center part of the water spraying area 23, and one or more positioning holes openings 233 are arranged above and below the magnetic element 232.

A rod 241 with a second magnetic element 242 and two positioning rods 243 are arranged under a first exfoliating member 24, so that the first exfoliating member 24 may be affixed to the center part of the water spraying area 23 through the magnetic element 232 and the magnetic element 242. Also, the two positioning rods 243 may be engaged with the positioning holes openings 233 so as to properly position the first exfoliating member 24. In addition, a plurality of holes 244 corresponding to the plurality of water spraying aperture 231 of the water outlet area 23 are provided in the first exfoliating member 24, so that water may flow out of the holes 244.

In addition, a second exfoliating member 25 may be arranged along the circumference of the spraying part 22 of the shower head 20. Also, a third exfoliating member 26 may be arranged on the rear side of the spraying part 22. The second and third exfoliating members 25, 26 may be provided with exfoliating beads with the same level of abrasiveness (as that of the first exfoliating member 24) or may be provided with exfoliating beads with a different level of abrasiveness.

In more detail, the three exfoliating members 24, 25, 26 may have the same level of abrasiveness or different levels of abrasiveness. The level of abrasiveness depends on the size of exfoliating beads fitted on the surface of any of these members 24, 25, 26. These exfoliating beads are affixed to the surface of a member via an adhesive, and each bead may be provided with a coating that does not cause any irritation or harm to our skin. Alternatively, these exfoliating beads may be formed integrally with the corresponding exfoliating member.

The level of abrasiveness depends on the size of exfoliating beads: the larger the beads, the higher level of abrasiveness. In the preferred embodiment, the first exfoliating member 24 has the lowest level of abrasiveness; the second exfoliating member 25 has the medium level of abrasiveness; the third exfoliating member 26 has the highest level of abrasiveness. In addition, each of the three exfoliating members has different curves so that a user may use them to scrub different parts of his body so as to smoothen and rejuvenate the skin. For example, a user may use the third exfoliating member 26 to scrape on the undersides of his feet.

In addition to the use of the magnetic elements 232 and 242, the three exfoliating members 24, 25, 26 may be held in place on the spraying part 22 of the shower head 20 with the positioning holes and positioning rods. Also, each of the three exfoliating members 24, 25, 26 may be replaced by a new member when it is worn out and may be replaced by another member with a different level of abrasiveness so as to meet the need of a user.

From the above, we can see that the shower head of the present invention may be used as a regular shower head and its first exfoliating member 24, second exfoliating member 25 and third exfoliating member 26 allow a user to scrape on specific parts of the body (such as the undersides of feet and knees) so as to smoothen and rejuvenate the skin; after exfoliation is done, the user may use the shower head to spray water on these parts.

To eliminate the disadvantages of the prior art, the shower head of the present invention may be used as a regular shower head and to exfoliate with several exfoliating members arranged around the spraying part of the shower head so that a user may use the shower head to smoothen and rejuvenate the skin.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A shower head with exfoliating members, comprising:

a tube having a first end connected with a water outlet;

a spraying part connected to a second opposite end of said tube via a handle portion, said spraying part having an inner side, a rear side, a center part, a plurality of water spraying apertures arranged in said inner side of the spraying part and forming a water outlet area, a first magnetic element arranged in said center part of said water outlet area, and two positioning openings disposed above and below said first magnetic element; and a first exfoliating member arranged at a predetermined position above said spraying part, said first exfoliating member has an exfoliating surface, a rod arranged under said first exfoliating member and having a second magnetic element attached to an end thereof, two positioning rods arranged under said first exfoliating member, and a plurality of holes provided in the first exfoliating member, said plurality of holes corresponding to said plurality of water spraying apertures of said water outlet area to allow water to flow out of said plurality of holes, wherein said first exfoliating member is affixed to said center part of the water outlet area via the magnetic force of said first and second magnetic elements, and wherein said two positioning rods engaged with the two positioning openings so as to properly position said first exfoliating member onto said spraying part.

2. The shower head with exfoliating members as in claim 1, wherein a second exfoliating member is arranged along the circumference of the spraying part.

3. The shower head with exfoliating members as in claim 2, wherein a third exfoliating member is arranged on the rear side of the spraying part.

4. The shower head with exfoliating members as in claim 3, wherein the first, second and third exfoliating members have the same level of abrasiveness.

5. The shower head with exfoliating members as in claim 4, wherein each of the first, second and third exfoliating members is formed by exfoliating beads bonded to the corresponding member through an adhesive.

6. The shower head with exfoliating members as in claim 5, wherein the level of abrasiveness of each of the first, second and third exfoliating members depends on the size of exfoliating beads fitted on the surface of them, and each bead is provided with a coating that does not cause any irritation or harm to our skin.

* * * * *